US009223284B2

(12) United States Patent
Hayashi

(10) Patent No.: US 9,223,284 B2
(45) Date of Patent: Dec. 29, 2015

(54) IMAGE FORMING APPARATUS, SUPPORTING MEMBER AND CLEANING DEVICE

(71) Applicant: KYOCERA Document Solutions Inc., Osaka (JP)

(72) Inventor: Kenichi Hayashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/335,019

(22) Filed: Jul. 18, 2014

(65) Prior Publication Data

US 2015/0030352 A1 Jan. 29, 2015

(30) Foreign Application Priority Data

Jul. 29, 2013 (JP) ..... 2013-156912

(51) Int. Cl.

| | |
|---|---|
| ***G03G 21/08*** | (2006.01) |
| ***G03G 21/00*** | (2006.01) |
| ***G03G 15/00*** | (2006.01) |
| *G03G 21/06* | (2006.01) |

(52) U.S. Cl.

CPC ..... *G03G 21/08* (2013.01); *G03G 15/6532* (2013.01); *G03G 21/06* (2013.01)

(58) Field of Classification Search

CPC .... G03G 21/08; G03G 21/06; G03G 15/6532

USPC ..... 399/128, 298, 299, 349

See application file for complete search history.

(56) References Cited

U.S. PATENT DOCUMENTS

2008/0145117 A1 6/2008 Takiguchi et al.
2012/0034008 A1 * 2/2012 Takiguchi ..... 399/397

FOREIGN PATENT DOCUMENTS

JP 2008-176246 A 7/2008

* cited by examiner

*Primary Examiner* — Hoang Ngo
(74) *Attorney, Agent, or Firm* — Studebaker & Brackett PC

(57) ABSTRACT

An image forming apparatus includes an image carrier, a development device, a transferring device, a static eliminating device, a cleaning device, a separating claw and a static elimination assisting device. On the image carrier, an electrostatic latent image is formed. The development device develops the electrostatic latent image by a toner. The transferring device transfers the toner on the image carrier to a recording sheet. The static eliminating device irradiates the image carrier with a light to eliminate a remained static charge. The cleaning device removes the toner remained on the image carrier. The separating claw is arranged between the static eliminating device and image carrier to separate the recording sheet from the image carrier. The static elimination assisting device radiates a light to a light obstruction area where is not irradiated with the light emitted from the static eliminating device on the image carrier due to the separating claw.

8 Claims, 7 Drawing Sheets

IMAGE FORMING APPARATUS, SUPPORTING MEMBER AND CLEANING DEVICE

INCORPORATION BY REFERENCE

This application is based on and claims the benefit of priority from Japanese Patent application No. 2013-156912 filed on Jul. 29, 2013, the entire contents of which are incorporated herein by reference.

BACKGROUND

The present disclosure relates to an image forming apparatus including an static eliminating device eliminating a static charge remained on a surface of a photosensitive drum and a separating claw separating a recording sheet with a transferred toner from the photosensitive drum, and moreover, relates a supporting member and a cleaning device.

In a general manner of forming an image, a surface of a photosensitive drum is electrically charged to a predetermined electrical potential by a charging device and an electrostatic latent image according to image data is formed on the surface by photographic exposure. The electrostatic latent image is developed with a toner (a developer) by a development device, and then, transferred on a recording sheet by a transferring device. The toner remained on the surface of the photosensitive drum is removed by a cleaning device and a static charge remained on the photosensitive drum is eliminated by a static eliminating device. In the photosensitive drum, a cycle having such electrical charging, photographic exposure and static elimination is repeated in the image forming.

In the transferring device, voltage with an opposite polarity to the toner is applied onto an opposite face to a face having the transferred toner in the recording sheet and the toner is transferred onto the recording sheet from the photosensitive drum. At this time, if the recording sheet is electrically charged, the recording sheet may stay electrostatically attracted onto the photosensitive drum and, therefore, a paper jam may be easily caused. The paper jam is easily caused, particularly, in a case of using many thin recording sheets or in a case of using a recording sheet being easy to electrically charge. In response, there is an image forming apparatus including a separating claw coming into contact with the photosensitive drum in a counter direction to a rotating direction of the photosensitive drum. The separating claw forcedly separates a leading edge of the recording sheet from the photosensitive drum.

Further, the image forming apparatus may include a conveyance auxiliary member at a downstream side from the separating claw in a conveying direction of the recording sheet. The conveyance auxiliary member is configured to guide the recording sheet so as to prevent flotation of recording sheet after separated by the separating claw and contact of an unfixed toner with components and others in the periphery of a conveying path of the recording sheet.

However, because attachment of the separating claw and conveyance auxiliary member causes significant cost increase, it is desirable that the separating claw and conveyance auxiliary member are configured attachable/detachable in accordance with use environment.

Meanwhile, miniaturization of the photosensitive drum according to space saving and acceleration of the image forming apparatus are progressed, and accordingly, a time from the static elimination of the photosensitive drum to the electrical charging in a next cycle is shortened. Therefore, it is necessary to consider an exposure memory of the photosensitive drum. The exposure memory is a phenomenon in which, between an exposed area and an unexposed area in the photosensitive drum after the static elimination, surface electrical potentials are different from each other, and then, the surface of photosensitive drum is electrically charged unevenly in the electrical charging in the next cycle. A problem of the exposure memory is feared particularly in an amorphous silicon photoreceptor.

As a countermeasure to this problem, it is necessary to provide an interval between the static eliminating device and charging device as wider as possible and to secure a time sufficiently attenuating the surface electrical potential of the photosensitive drum before the electrical charging in the next cycle. Therefore, it is necessary to position the static eliminating device at an upstream side from the cleaning device in the rotating direction of the photosensitive drum.

Therefore, the separating claw and conveyance auxiliary member and the static eliminating device are arranged between the transferring device and cleaning device. If the photosensitive drum is miniaturized, because the space between the transferring device and cleaning device becomes narrower, the separating claw and conveyance auxiliary member and the static eliminating device must be arranged in this narrow space.

As a countermeasure to such a problem, it is considered that a space as an optical path of the static elimination light between the static eliminating device and photosensitive drum is used for arranging the separating claw and conveyance auxiliary member. However, because the separating claw and conveyance auxiliary member or a member supporting the separating claw and conveyance auxiliary member obstruct the static elimination light, a light obstruction area where is not irradiated with the static elimination light is formed on the photosensitive drum.

SUMMARY

In accordance with an embodiment of the present disclosure, an image forming apparatus includes an image carrier, a development device, a transferring device, a static eliminating device, a cleaning device, a separating claw and a static elimination assisting device. On the image carrier, an electrostatic latent image is formed. The development device develops and visualizes the electrostatic latent image by a toner. The transferring device transfers the toner on the image carrier to a recording sheet. The static eliminating device irradiates the image carrier with a light to eliminate a remained static charge. The cleaning device removes the toner remained on the image carrier. The separating claw is arranged between the static eliminating device and image carrier to separate the recording sheet from the image carrier. The static elimination assisting device radiates a light to a light obstruction area where is not irradiated with the light emitted from the static light eliminating device on the image carrier due to obstruction by the separating claw.

In accordance with an embodiment of the present disclosure, a supporting member is arranged between an image carrier on which a toner image is formed and a static eliminating device irradiating the image carrier with a light to eliminate a remained static charge after the toner image is transferred on a recording sheet. The supporting member is configured so as to support a separating claw separating the recording sheet from the image carrier, and a static elimination assisting device radiating a light to a light obstruction area where is not irradiated with the light emitted from the static light eliminating device on the image carrier due to obstruction by the separating claw.

In accordance with an embodiment of the present disclosure, a cleaning device removes a toner remained on an image carrier after a toner image formed on the image carrier is transferred on a recording sheet. The cleaning device includes an attachable/detachable supporting member. The supporting member is configured to so as to support a separating claw separating the recording sheet from the image carrier, and a conveyance auxiliary member restraining flotation of the recording sheet separated by the separating claw.

The above and other objects, features, and advantages of the present disclosure will become more apparent from the following description.

DETAILED DESCRIPTION

In the following, with reference the drawings, an image forming apparatus according to an embodiment of the present disclosure will be described.

Figure 1:
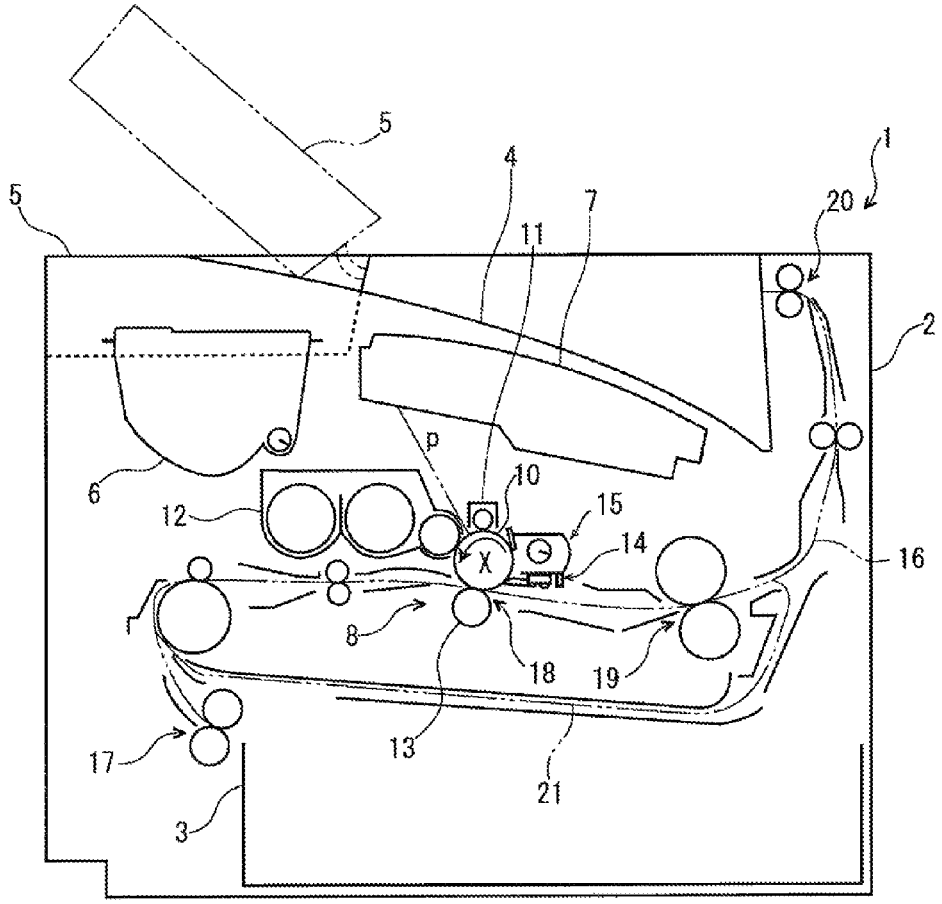
FIG. 1 is a schematic diagram schematically showing a structure of a printer according to an embodiment of the present disclosure.

First, with reference to FIG. 1, the structure of a printer 1 as an electrographic image forming apparatus according to the embodiment of the present disclosure will be described. FIG. 1 is a schematic diagram schematically showing the printer according to the embodiment of the present disclosure. Hereinafter, the left-hand side of FIG. 1 indicates the front side of the printer 1 and orthogonal directions to forward and backward directions viewed from the front side indicate left and right directions.

As shown in FIG. 1, the printer 1 includes a box-like formed printer main body 2. In a lower part of the printer main body 2, a sheet feeding cartridge 3 storing recording sheets (not shown) is installed and, in a top face of the printer main body 2, a sheet ejected tray 4 is formed. In the top face of the printer main body 2, an upper cover 5 is openably/closably attached to the front side of the sheet ejected tray 4. Below the upper cover 5, a toner container 6 as a toner case containing a toner is installed.

In an upper part of the printer main body 2, an exposure device 7 is located below the sheet ejected tray 4. Below the exposure device 7, an image forming part 8 is arranged. In the image forming part 8, a photosensitive drum 10 as an image carrier is rotatably arranged. Around the photosensitive drum 10, a charging device 11, a development device 12 as an attachment member, a transfer roller 13, a static eliminating device 14 and a cleaning device 15 are located in order along a rotating direction (refer to an arrow X in FIG. 1) of the photosensitive drum 10.

Inside the printer main body 2, a conveying path 16 for the recording sheet is arranged. At an upstream end in the conveying path 16, a sheet feeder 17 is positioned. At an intermediate stream part in the conveying path 16, a transferring part 18 composed of the photosensitive drum 10 and transfer roller 13 is positioned. At a downstream part in the conveying path 16, a fixing device 19 is positioned. At a downstream end in the conveying path 16, a sheet ejecting part 20 is positioned. Below the conveying path 16, an inversion path 21 for duplex printing is arranged.

When the power is supplied to the printer 1, initial determination, such as temperature determination of the fixing device 19, is carried out. Subsequently, in the printer 1, when a printing start is directed, image forming operation is carried out as follows.

First, the surface of the photosensitive drum 10 is electric-charged by the charging device 11. Then, photographic exposure corresponding to image data on the photosensitive drum 10 is carried out by a laser light (refer to a two-dot chain line p in FIG. 1) from the exposure device 7, thereby forming an electrostatic latent image on the surface of the photosensitive drum 10. Subsequently, the development device 12 develops (visualizes) the electrostatic latent image to a toner (developer) image.

On the other hand, the recording sheet fed from the sheet feeding cartridge 3 by the sheet feeder 17 is conveyed to the transferring part 18 in a suitable timing for the above-mentioned image forming operation, and then, the toner image on the photosensitive drum 10 is transferred onto the recording sheet in the transferring part 18. The recording sheet with the transferred toner image is conveyed to a downstream side in the conveying path 16 to go into the fixing device 19, and then, the toner image is fixed on the recording sheet in the fixing device 19. The recording sheet with the fixed toner image is ejected from the sheet ejecting part 20 to the sheet ejected tray 4. An electrical potential remained on the photosensitive drum 10 is eliminated by the static eliminating device 14. The toner remained on the photosensitive drum. 10 is collected by the cleaning device 15.

Figure 2A:
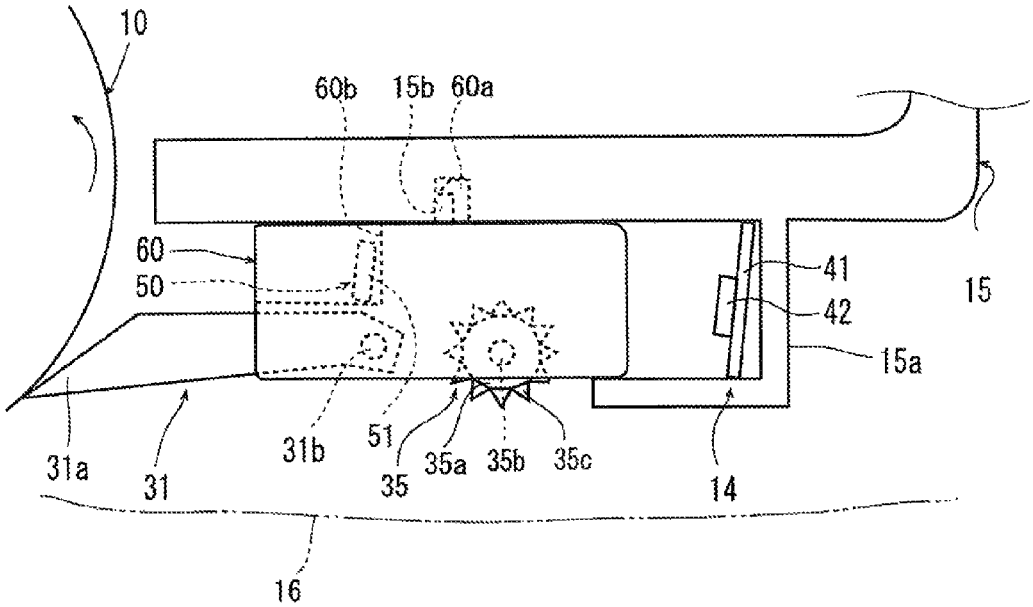
FIG. 2A is a schematic side view and FIG. 2B is a schematic plan view each schematically showing a static eliminating device and its periphery in the printer according to the embodiment of the present disclosure.
Figure 2B:
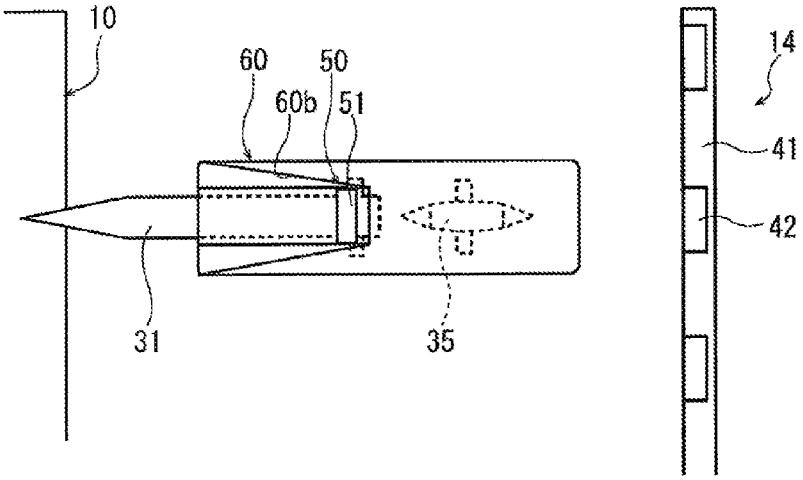

Next, with reference to FIG. 2A and FIG. 2B, the static eliminating device 14 and its periphery will be described. FIG. 2A is a side view showing the static eliminating device 14 and FIG. 2B is a plan view showing the static eliminating device 14.

The static eliminating device 14 is configured so that a plurality of light emitting diode (LED) chips (illuminants) 42 as a light source are arranged in a line in an axial direction on an elongated substrate 41. A length of the substrate 41 is roughly equal to a length in the axial direction of the photosensitive drum 10. The LED chip 42 may be configured to emit a static elimination light with a wavelength of 650 nm and a static elimination light amount of 4.0 $\mu J/cm^2$.

The static eliminating device 14 is supported by a supporting part 15*a* formed in a lower face of the cleaning device 15.

Each LED chip 42 is supported in a slightly upward inclined posture so that a center axis of a light emitting face is positioned roughly perpendicular to the surface of the photosensitive drum 10, and then, irradiates entire area in the left and right directions of the surface of the photosensitive drum 10 with the static elimination light.

In a space which forms an optical path of the static elimination light of the static eliminating device 14 between the static eliminating device 14 and photosensitive drum 10, separating claws 31, conveyance auxiliary members 35 and static elimination assisting devices 50 are arranged and supported by a supporting member 60.

The separating claw 31 is a bar like member having a rectangular section. A leading tip 31*a* of the separating claw 31 is formed in a tapered claw like shape in a side view and a plan view. In left and right side faces of a base end side of the separating claw 31, rotation shafts 31*b* respectively extending in the left and right directions are formed.

The conveyance auxiliary member 35 is a disk like member and has a disk part 35*a* and rotation shafts 35*b* extending in the left and right directions from the center of the disk part 35*a*. Around an external circumference face of the disk part 35*a*, a plurality of projected parts 35*c* having respective acute top portions are formed radially.

The static elimination assisting device 50 is a light source irradiating a predetermined area of the surface of the photosensitive drum 10 with the static elimination light. As the static elimination assisting device 50, an LED chip (illuminant) (hereinafter, called as a static elimination assisting LED chip 51) may be applied. As the static elimination assisting LED chip 51, the same one as the LED chip 42 used as the light source of the static eliminating device 14 may be applied.

The supporting member 60 has a rectangular parallelepiped shape elongated in the forward and backward directions. The supporting member 60 has a length in the forward and backward directions shorter than an interval between the static eliminating device 14 and photosensitive drum 10 and a width in the left and right directions slightly wider than a width of the static elimination assisting LED chip 51. As a material of the supporting member 60, a general resin may be applied, and a material with high optical transparency must not be applied.

In an upper face of the supporting member 60, a hook like protruding part 60*a* is formed. The protruding part 60*a* is attachably/detachably engaged with a concave part 15*b* formed in the lower face of the cleaning device 15. The concave part 15*b* is formed in front of the LED chip 42 of the static eliminating device 14.

In a lower face of the supporting member 60, the separating claw 31 and conveyance auxiliary member 35 are supported. The separating claw 31 is swingable around the rotation shafts 31*b* at the front side of the lower face of the supporting member 60. The separating claws 31 are biased by torsion coil springs (not shown) so that the leading tips 31*a* come into contact with the surface of the photosensitive drum 10 in a counter direction to the rotating direction of the photosensitive drum 10. A biasing force of the torsion coil spring is determined to an extremely small force so that the leading tip 31*a* of the separating claw 31 does not hurt the surface of the photosensitive drum 10.

The conveyance auxiliary member 35 is rotatable around the rotation shafts 35*b* at the rear side of the lower face of the supporting member 60. A lower part from the rotation shafts 35*b* in the disk part 35*a* of the conveyance auxiliary member 35 is protruded downward from the supporting member 60.

Near the center in a longitudinal direction of the supporting member 60, the static elimination assisting LED chip 51 is supported. In the center in a width direction of the supporting member 60, a notch part 60*b* opened in a front face and the upper face is formed. As shown in FIG. 2B, an interval between left and right side faces of the notch part 60*b* is gradually widened outward in the left and right directions from the depth side to the front side. The static elimination assisting LED chip 51 is supported in the depth side of the notch part 60*b* so that a center axis of a light emitting face is positioned roughly perpendicular to the surface of the photosensitive drum 10, and then, irradiates a predetermined area of the surface of the photosensitive drum 10 with the static elimination light.

Figure 3A:
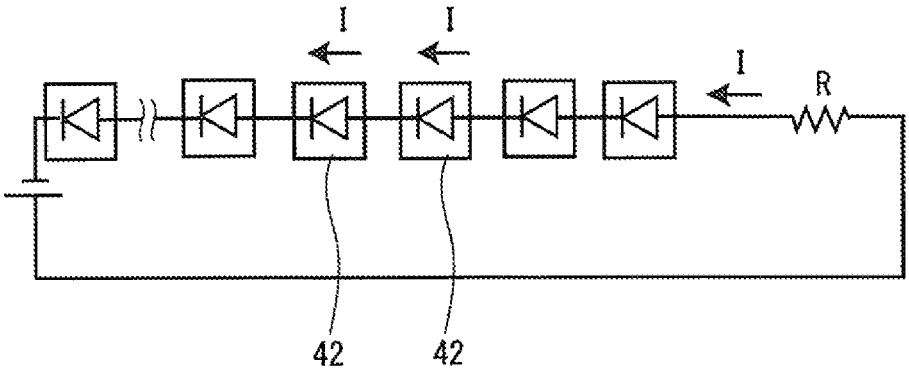
FIG. 3A is a schematic wiring diagram of the static eliminating device and FIG. 3B is a wiring diagram of the static eliminating device being electrically connected to the static elimination assisting device each useful for understanding wiring of a static elimination assisting device in the printer according to the embodiment of the present disclosure.
Figure 3B:
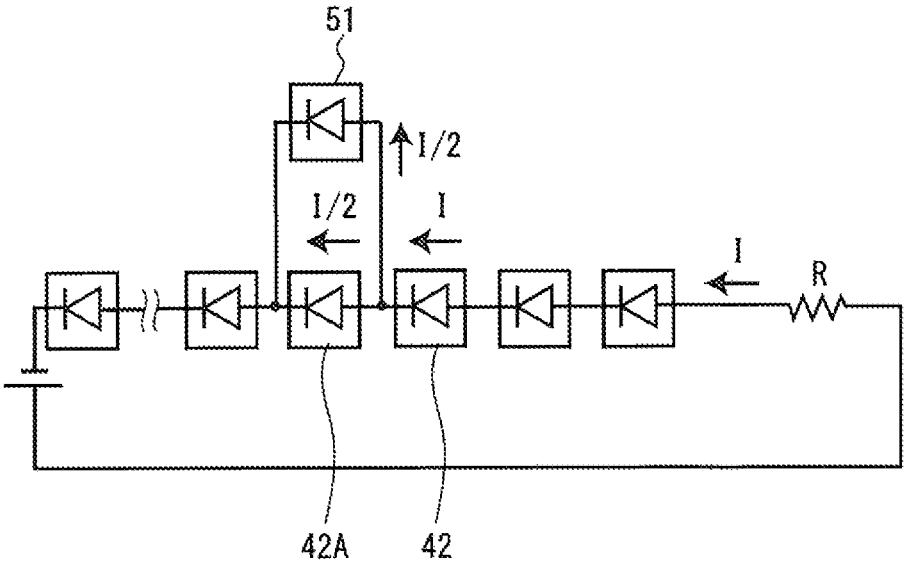

As shown in FIG. 3A and FIG. 3B, wiring of the static elimination assisting LED chip 51 will be described. FIG. 3A is a diagram showing wiring of the LED chips in the static eliminating device. FIG. 3B is a diagram showing wiring of the LED chips and static elimination assisting LED chip connected those LED chips in the static eliminating device.

As shown in FIG. 3A, the plurality of the LED chips 42 of the static eliminating device 14 are connected electrically in series and driven by constant current control. An anode of a power source is connected to one end of the series connected LED chips 42 via a current limit resistance R and a cathode is connected to another end. When a current of an amount I is supplied from the power source, constant current of the amount I is supplied to all the LED chips 42.

As shown in FIG. 3B, the static elimination assisting LED chip 51 is connected electrically in parallel to one LED chip 42A of the series connected LED chips 42 in the static eliminating device 14. In such a parallel connection, entire current amount I is distributed to two LED chips 51 and 42A in half, that is, to the static elimination assisting LED chip 51, the current amount of I*½ is supplied and, to the parallel connected LED chip 42A, the current amount of I*½ is supplied. Therefore, since a drive current amount of the static elimination assisting LED chip 51 is smaller than a drive current amount of the parallel unconnected LED chip 42, a light amount of the static elimination assisting LED chip 51 is smaller than a light amount of the parallel unconnected LED chip 42.

Figure 4:
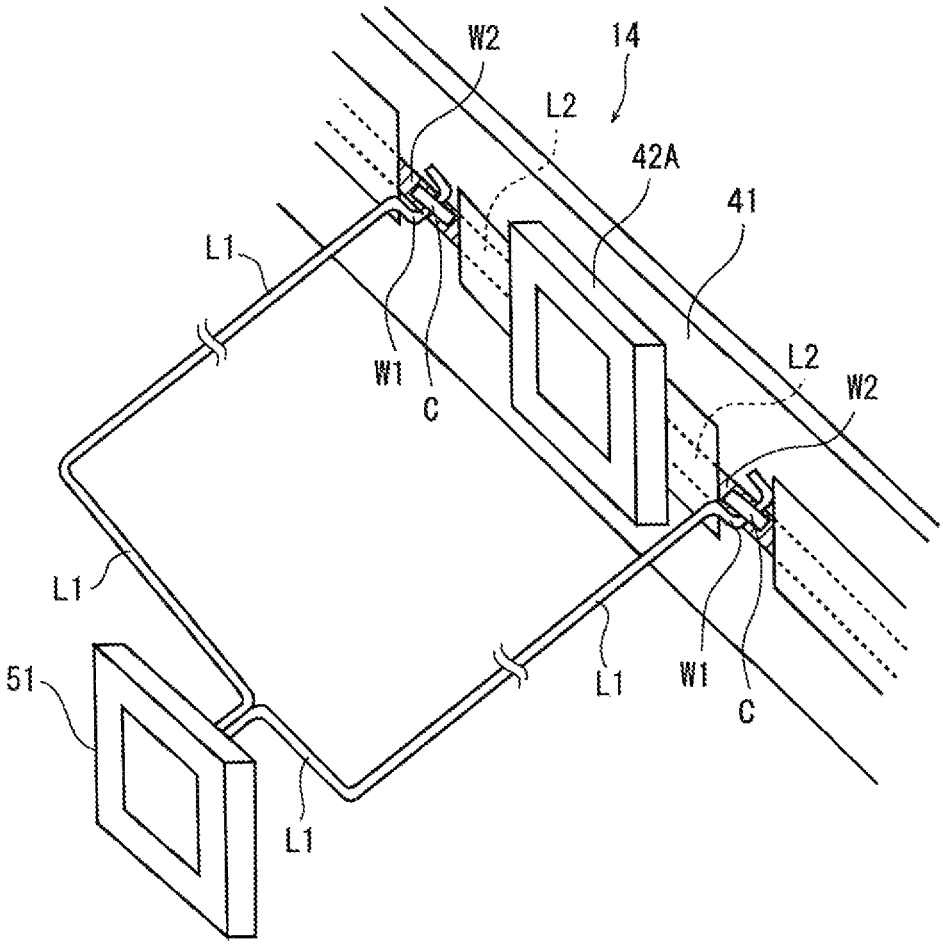
FIG. 4 is a perspective view showing a connecting part between the static elimination assisting device and static eliminating device in the printer according to the embodiment of the present disclosure.

With reference to FIG. 4, a connecting part of the static elimination assisting LED chip 51 will be described. FIG. 4 is a perspective view schematically showing the connecting part between the static elimination assisting LED chip and the LED chip of the static eliminating device.

The static elimination assisting LED chip 51 are connected to the substrate 41 of the static eliminating device 14 by two lead wires L1. The terminal ends of the two lead wires L1 are stripped to expose conducting parts W1. The exposed conducting parts W1 are bent in roughly U-shapes. On the other hand, in the LED chip 42A to which the static elimination assisting LED chip 51 is connected in parallel, two lead wires L2 connected to the LED chip 42A are partially exposed to make electrical conducting parts W2.

The exposed conducting parts W1 of the two lead wires L1 of the static elimination assisting LED chip 51 are roughly orthogonally overlapped to the exposed electrical conducting parts W2 of the two lead wires L2 of the LED chip 42A and fixed by conducting members C. Thereby, the two lead wires L1 of the static elimination assisting LED chip 51 are conducted to the two lead wires L2 of the LED chip 42A, and then, the static elimination assisting LED chip 51 is connected in parallel to the LED chip 42A of the static eliminating device 14.

Figure 5:
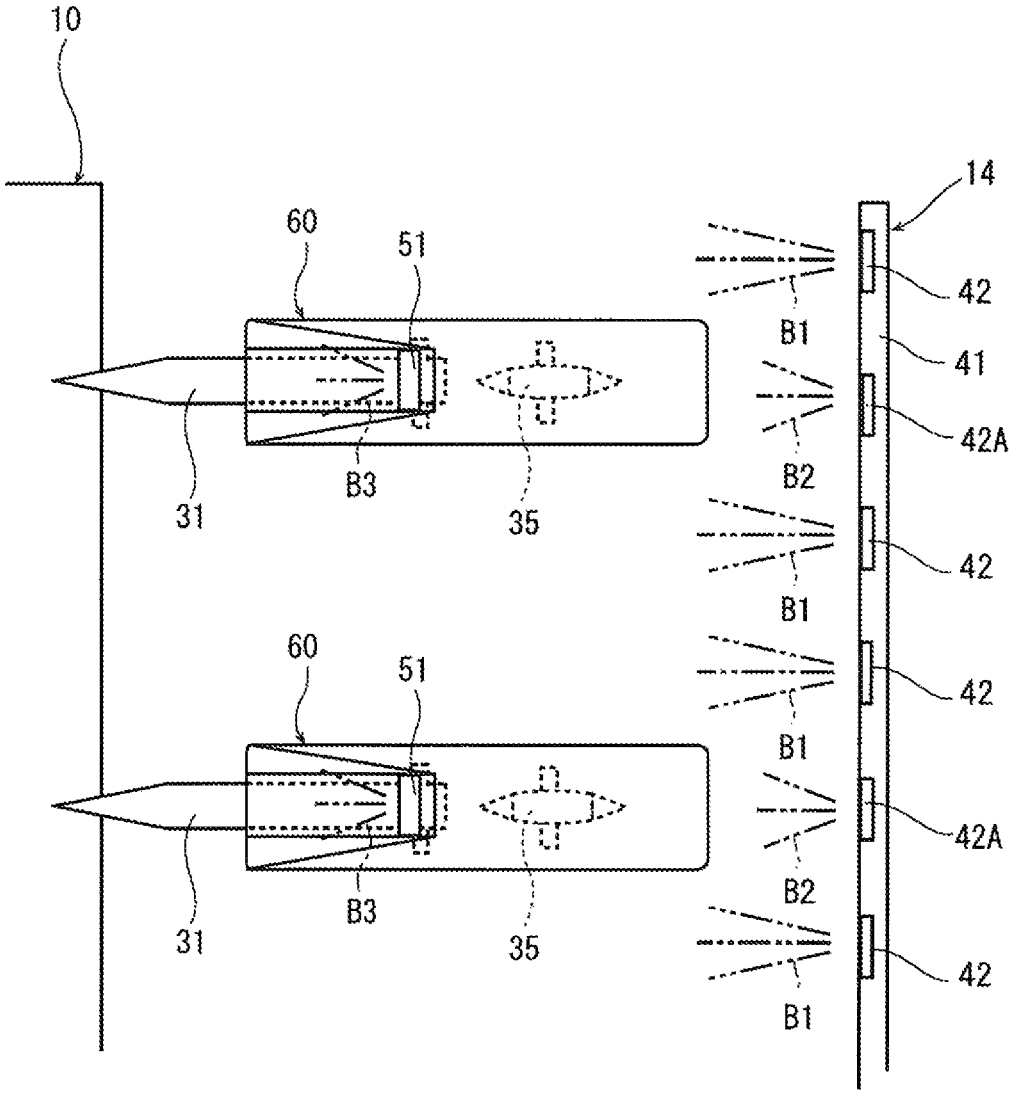
FIG. 5 is a plan view useful for understanding an action of the static elimination assisting device and static eliminating device in the printer according to the embodiment of the present disclosure.

Next, with reference to FIG. 5, an action of the static eliminating device having the above-mentioned configuration will be described. FIG. 5 is a plan view showing the periphery of the static eliminating device.

In a case of using many thin recording sheets or in a case of using a recording sheet being easy to electrically charge, alternatively, in a case of causing frequently a paper jam due to electrostatic attraction of the recording sheet onto the photosensitive drum, one or more supporting members 60 are attached to the cleaning device 15 in a posture directing the separating claw 31 to the photosensitive drum 10. Simultaneously, the static elimination assisting LED chip 51 is connected in parallel to a predetermined LED chip 42 of the static eliminating device 14.

The leading edge of the recording sheet with the transferred toner is first separated from the surface of the photosensitive drum 10 by the separating claw 31, and then, the conveyance auxiliary member 35 contacts with the recording sheet. The conveyance auxiliary member 35 is rotated around the rotation shafts 35*b* in accordance with the conveyance of the recording sheet, and simultaneously, presses the recording sheet by the acute tip of the projected parts 35*c* so as to restrain floatation. At this time, since the acute tip of the projected part 35*c* contacts with the recording sheet at a point, the unfixed toner on the recording sheet is not disturbed.

In the static eliminating device 14, a light B1 emitted from the LED chip 42 is radiated to the surface of the photosensitive drum 10, thereby eliminating the electrical potential remained on the photosensitive drum 10. Incidentally, because a light B2 emitted from the LED chip 42A connected in parallel to the static elimination assisting LED chip 51 is obstructed by the supporting member 60, separating claw 31 and conveyance auxiliary member 35, alight obstruction area where is not irradiated with the light B2 is occurred on the photosensitive drum 10. Since, to the light obstruction area, a light B3 emitted from the static elimination assisting LED chip 51 supported by the supporting member 60 is radiated, the static elimination light is radiated to entire area in the left and right directions of the photosensitive drum 10.

As described above, in the printer 1 according to the embodiment of the present disclosure, while preventing the static elimination light obstruction area from being formed on the surface of the photosensitive drum 10, in the space secured as the optical path of the static elimination light between the static eliminating device 14 and photosensitive drum 10, the separating claw 31 and conveyance auxiliary member 35 are supported as necessary. Therefore, it is possible to save a space for arranging a member supporting the separating claw 31 and conveyance auxiliary member 35 in a conventional printer. Accordingly, it is possible to hardly cause the paper jam if the thin recording paper or the recording sheet being easy to electrically charge is used, and to save a space.

Because the static elimination assisting LED chip 51 is positioned nearer to the photosensitive drum 10 than the LED chip 42 of the static eliminating device 14, if the light amount of the static elimination assisting LED chip 51 were equal to the light amount of the LED chip 42 of the static eliminating device 14, the static elimination assisting LED chip 51 may have excess light amount. However, since the drive current amount of the static elimination assisting LED chip 51 is reduced due to the parallel connection, the light amount of the static elimination light emitted from the static elimination assisting LED chip 51 is smaller than the light amount of the LED chip 42 of the static eliminating device 14. Therefore, to the area irradiated with the static elimination light emitted from the static elimination assisting LED chip 51 and to the area irradiated with the static elimination light emitted from the LED chip 42 of the static eliminating device 14, the static elimination light of roughly even light amount can be radiated.

Moreover, since the static elimination assisting LED chip 51 is connected in parallel to the LED chip 42A of the static eliminating device 14, it is unnecessary to provide individually a power source for the static elimination assisting LED chip 51, and then, it is possible to simplify the attachment and wiring of the static elimination assisting LED chip 51.

In addition, since the separating claw 31, conveyance auxiliary member 35 and static elimination assisting LED chip are supported in the supporting member 60 attachable/detachable with respect to the cleaning device 15, it is possible to attach or detach the separating claw 31, conveyance auxiliary member 35 and static elimination assisting LED chip 51 simultaneously by one time operation.

Figure 6:
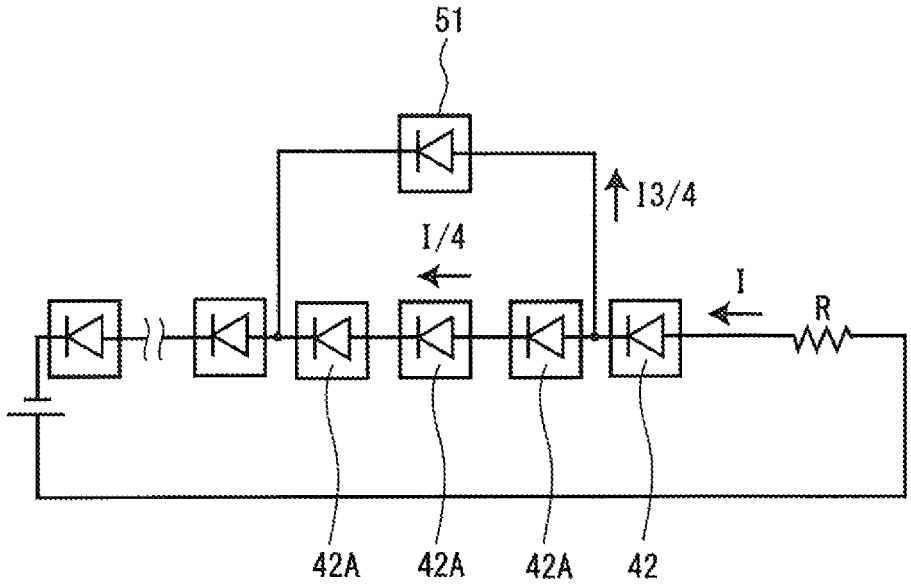
FIG. 6 is a schematic diagram useful for understanding another example of the wiring of the static elimination assisting device in the printer according to the embodiment of the present disclosure.

With reference to FIG. 6, another example of the wiring of the static elimination assisting LED chip will be described.

In this other example, the static elimination assisting LED chip 51 is connected in parallel to three LED chips 42A of the static eliminating device 14 connected in series. Since the distribution of the current amount I is varied in accordance with the resistance of each LED chip, to the static elimination assisting LED chip 51, the current amount of I*¾ is supplied and, to the three LED chips 42A, the current amount of I*¼ is supplied. Thus, the light amount of the static elimination assisting LED chip 51 is increased compared with the static eliminating device according to the above-described embodiment.

Ina case where the light amount of the static elimination assisting LED chip 51 is insufficient, by connecting in parallel to several LED chips 42 of the static eliminating device 14, it is possible to increase the light amount of the static elimination assisting LED chip 51.

In the embodiment, the example of supporting the separating claw 31, conveyance auxiliary member 35 and static elimination assisting LED chip 51 by the supporting member 60 was described. However, in another embodiment, the separating claw 31, conveyance auxiliary member 35 and static elimination assisting LED chip 51 may be supported attachably/detachably in the cleaning device 15 individually. Alternatively, the separating claw 31, conveyance auxiliary member 35 and static elimination assisting LED chip 51 may be fixed to the cleaning device 15. As a manner of engaging the supporting member 60 and cleaning device 15, a manner using a double sided tape or others may be applied.

Although, in the embodiment, the static elimination assisting LED chip 51 is driven by connecting in parallel to the LED chip 42 of the static eliminating device 14, in another embodiment, the static elimination assisting LED chip 51 may be driven electrically separately from the static eliminating device 14. In such a case, as the static elimination assisting LED chip 51, another LED chip with a light amount smaller than the light amount of the LED chip 42 of the static eliminating device 14 is applied. As the static elimination assisting device, another light source except for the LED chip may be applied.

Although, in the embodiment, the static elimination assisting LED chip 51 is positioned in front of the LED chip 42 of the static eliminating device 14, the position of the static elimination assisting LED chip 51 is not restricted from this position. In another embodiment, the position of the static elimination assisting LED chip 51 may be positioned so as to radiate the light to the light obstruction area on the surface of the photosensitive drum 10 where is not irradiated with the light emitting from the LED chip 42 of the static eliminating device 14 due to the obstruction by the supporting member 60, separating claw 31 and conveyance auxiliary member 35.

Although, in the embodiment, a configuration of the static eliminating device 14 arranging the plurality of the LED chips 42 was described, in another embodiment, the static eliminating device 14 may apply another light source, such as a light guide.

Although, in the embodiment, the conducting members are used for conducting the lead wires of the static elimination assisting LED chip 51 and the lead wires of the static eliminating device 14, in another embodiment, another manner, such as a soldering, may be applied.

Although, in the embodiment, the printer including both the separating claw 31 and conveyance auxiliary member 35 was described, in another embodiment, the conveyance auxiliary member 35 is not necessarily arranged.

Figure 7:
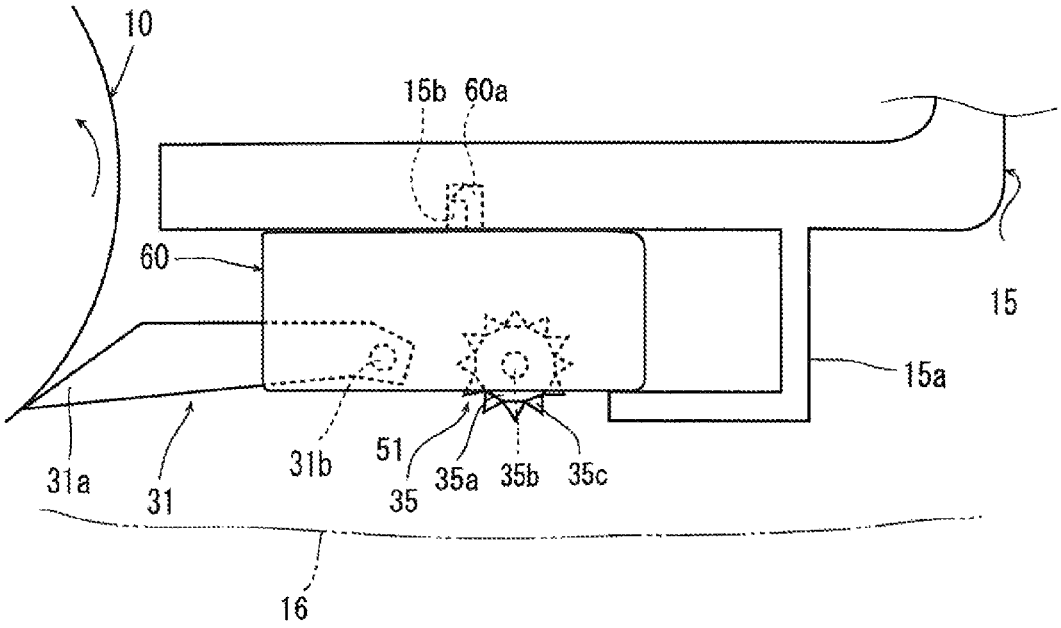
FIG. 7 is a side view showing a cleaning device and its periphery in the printer according to another embodiment of the present disclosure.

Next, with reference to FIG. 7, a cleaning device in a printer according to another embodiment of the present disclosure will be described. FIG. 7 is a side view showing the cleaning device and its periphery. In this other embodiment, similar components and parts to the above-mentioned embodiment are indicated by the same reference numerals and detail descriptions of the similar components and parts are omitted.

In a cleaning device 15, a supporting member 60 is supported attachably/detachably. In a lower face of the supporting member 60, a separating claw 31 and a conveyance auxiliary member 35 are supported. The separating claw 31 is supported swingable around a rotation shaft 31*b* at the front side of the lower face of the supporting member 60. The conveyance auxiliary member 35 is supported rotatable around rotation shafts 35*b* at the rear side of the lower face of the supporting member 60.

The embodiment was described in a case of applying the configuration of the present disclosure to the printer 1. On the other hand, in another embodiment, the configuration of the disclosure may be applied to another image forming apparatus, such as a copying machine, a facsimile or a multifunction peripheral, except for the printer 1.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. An image forming apparatus comprising:

an image carrier on which an electrostatic latent image is formed;

a development device developing and visualizing the electrostatic latent image by a toner;

a transferring device transferring the toner on the image carrier to a recording sheet;

a static eliminating device irradiating the image carrier with a light to eliminate a remained static charge;

a cleaning device removing the toner remained on the image carrier;

a separating claw arranged between the static eliminating device and image carrier to separate the recording sheet from the image carrier, and a static elimination assisting device radiating a light to a light obstruction area where the light obstruction area is not irradiated with the light emitted from the static eliminating device on the image carrier due to obstruction by the separating claw.

2. The image forming apparatus according to claim 1, wherein the separating claw is supported by a supporting member attachable/detachable to the cleaning device and the static elimination assisting device is supported by the supporting member.

3. The image forming apparatus according to claim 2, wherein the supporting member is configured to so as to support a conveyance auxiliary member restraining flotation of the recording sheet separated by the separating claw.

4. The image forming apparatus according to claim 2, wherein the supporting member is attached to the cleaning device, in case that the image forming is carried out to many thin recording sheets, or in case that the image forming is carried out to a recording sheet being easy to electrically charge, or in case that the paper jam is caused frequently.

5. The image forming apparatus according to claim 1, wherein the static eliminating device includes a plurality of illuminants connected in series, the static elimination assisting device includes the similar illuminant to the illuminants of the static eliminating device, and the illuminant of the static elimination assisting device is arranged nearer to the image carrier than the static eliminating device and connected electrically in parallel to the illuminants of the static eliminating device.

6. The image forming apparatus according to claim 5, wherein the illuminant of the static elimination assisting device is electrically driven separately from the illuminants of the static eliminating device.

7. The image forming apparatus according to claim 5, wherein the illuminant of the static elimination assisting device has a light amount smaller than a light amount of the illuminant of the static eliminating device.

8. A supporting member arranged between an image carrier on which a toner image is formed and a static eliminating device irradiating the image carrier with a light to eliminate a remained static charge after the toner image is transferred on a recording sheet, wherein the supporting member is configured so as to support a separating claw separating the recording sheet from the image carrier, and a static elimination assisting device radiating a light to a light obstruction area where the light obstruction area is not irradiated with the light emitted from the static eliminating device on the image carrier due to obstruction by the separating claw.

* * * * *